United States Patent [19]

Fujiwara et al.

[11] Patent Number: 4,620,418

[45] Date of Patent: Nov. 4, 1986

[54] STIRLING ENGINE

[75] Inventors: Michio Fujiwara, Akashi; Yoshio Kazumoto, Itami; Tamotsu Nomaguchi, Minou; Kazuo Kashiwamura, Amagasaki, all of Japan

[73] Assignee: Mitsubishi Denki Kabushiki Kaisha, Tokyo, Japan

[21] Appl. No.: 751,725

[22] Filed: Jul. 3, 1985

[30] Foreign Application Priority Data

Jul. 6, 1984 [JP] Japan ..... 59-141025

[51] Int. Cl.[4] ..... F02G 1/04

[52] U.S. Cl. ..... 60/517; 62/6; 277/3

[58] Field of Search ..... 60/517, 521, 525; 62/6; 277/3

[56] References Cited

U.S. PATENT DOCUMENTS 3,667,348 6/1972 Neelen ..... 60/517 X
4,093,239 6/1978 Sugahara ..... 60/517 X
4,257,230 3/1981 Lundholm ..... 60/517

OTHER PUBLICATIONS

"Development of a Stirling Engine Rod Seal", by Short, M. G.; 17th IECEC, Los Angeles, pp. 1881 to 1884, 1982.

*Primary Examiner*—Stephen F. Husar
*Attorney, Agent, or Firm*—Birch, Stewart, Kolasch & Birch

[57] ABSTRACT

A Stirling engine wherein a pressure variation is provided by a reciprocative movement of a displacer and is effected upon a power piston to obtain an output motive force. A first elastic film is provided at the displacer rod projecting into the crankcase so as to produce a first hermetically sealed space bounded by the expansion cylinder. A second elastic film is provided at the power piston rod so as to produce a second hermetically sealed space below the power piston. A pressure adjusting device equalizes the mean pressure of a reactive space, which includes the first and the second hermetically sealed spaces, and that of the crankcase.

4 Claims, 5 Drawing Figures

STIRLING ENGINE

FIELD OF THE INVENTION

The present invention relates to a Stirling engine, and more particularly, to an improvement of the mechanism for sealing the working gas.

BACKGROUNO OF THE INVENTION

In order to explain a prior art Stirling engine, reference will be particularly made to FIG. 1:

FIG. 1 is a schematic diagram of a displacer type Stirling engine as a typical example of a Stirling engine. The reference numeral 1 designates an expansion cylinder, the numeral 2 designates a heater tube, the numeral 3 designates a regenerator, the numeral 4 designates a cooler tube, the numeral 5 designates a displacer, and the numeral 6 designates a displacer rod. The numeral 7 designates a first rod seal for sealing the sliding gap between the expansion cylinder 1 and the rod 6. The numeral 8 designates a compression cylinder. The numeral 9 designates a first communicating pipe located between the compression cylinder 8 and the expansion cylinder 1. The numeral 10 designates a power piston. The numeral 11 designates a power piston rod. The numeral 12 designates a second rod seal for sealing the sliding gap between the compression cylinder 8 and the power piston rod 11. The numeral 13 designates a first connecting rod for converting the rotating force of a crankshaft to the reciprocative movement of the displacer 5. The numeral 14 designates a second connecting rod for converting the reciprocative movement of the power piston 10 to a rotating force of the crankshaft. The numeral 15 designates the crankshaft which utilizes the reciprocative movement of the displacer 5 and that of the power piston 10 while keeping a predetermined phase difference therebetween to obtain a rotating force. The numerals 16 and 17 designate main bearings for the crankshaft 15. The numeral 100 designates a crankcase for supporting the components 1 to 17 arranged at respective predetermined positions. The numeral 18 designates a buffer chamber.

In this Stirling engine, the heater tube 2 is continuously heated by such as a burner, and the cooler tube 4 is continuously cooled by such as water to generate a pressure variation in the cylinder. Thus the power piston 10 moves up and downwards to generate a motive force.

It is common practice to use hydrogen or helium as the working gas contained in the expansion cylinder 1 and the compression cylinder 8 in order to operate the Stirling engine at a high efficiency and a high output motive force. Accordingly, one of the most important problems in utilizing the Stirling engine resides in the hermetical sealing of the hydrogen or helium.

In the prior art device, however, a lip seal or an O-ring is used as the first rod seal 7 and the second rod seal 12, and it was difficult to seal the hydrogen or helium perfectly for a long period of time.

Regarding another prior art Stirling engine, there is an article "DEVELOPMENT OF A STIRLING ENGINE ROD SEAL" by SHORT, M. G. 17th IECEC, LOS ANGELES, p 1881 to 1884, 1982, wherein there is described a construction and a function of a sliding seal made of PTFE or the like used as a Stirling engine rod seal. According to this article, it was impossible to perfectly seal the working gas or the oil in the moving state.

SUMMARY OF THE INVENTION

The present invention is directed to solving the problems pointed out above, and has for its object to provide a Stirling engine capable of sealing the working gas in the cylinder perfectly, and furthermore capable of enhancing the sealing life to a great extent.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to the present invention, there is provided a Stirling engine where a pressure variation is provided by a reciprocative movement of a displacer and it is effected upon a power piston to obtain an output motive force, which comprises: a first elastic film which is provided at the displacer rod projecting into the crankcase so as to produce a first hermetically sealed space with the expansion cylinder; a second elastic film which is provided at the power piston rod so as to produce a second hermetically sealed space below the power piston; and a pressure adjusting means which equalizes the mean pressure of the reactive space, which includes the first and the second hermetically sealed spaces, and that of the crankcase.

DETAILED DESCRIPTION OF THE PREFERRED EMBODIMENT

Figure 1:
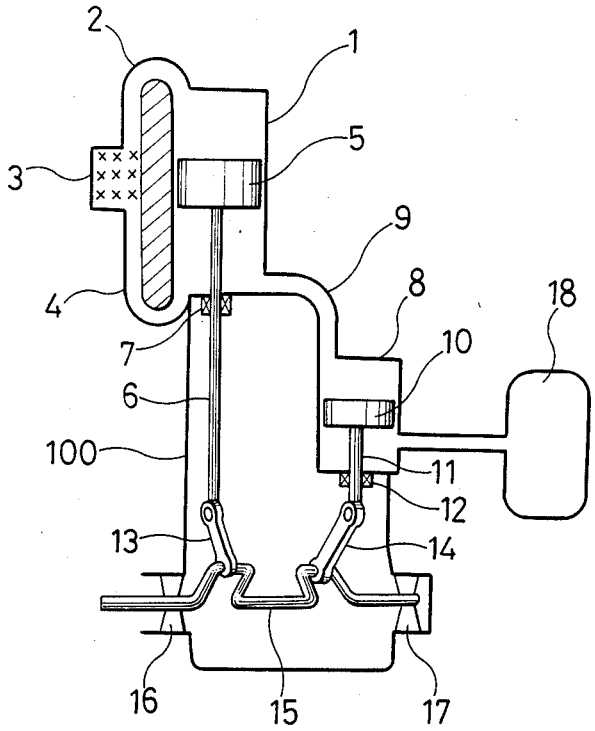
F I G 1. (PRIOR ART)
FIG. 1 is a schematic diagram showing a typical example of a prior art Stirling engine.
Figure 2:
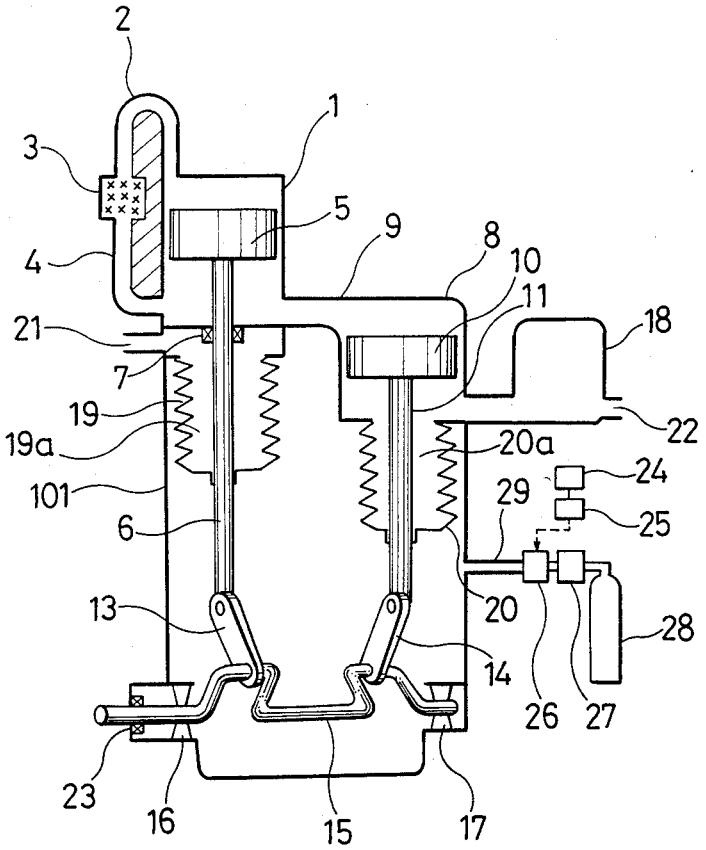
FIG. 2 is a schematic diagram showing a first or $\gamma$ type Stirling engine as a first embodiment of the present invention.

In order to explain a first embodiment of the present invention in detail, reference will be particularly made to FIG. 2 wherein the same reference numerals are used to designate the same elements as those shown in FIG. 1.

The reference numeral 101 designates a pressure containing crankcase for supporting the expansion cylinder 1 and the compression cylinder 8 arranged at respective predetermined positions. The crankcase 101 can be subjected to a pressure application up to the same pressure as the mean pressure of the working gas in the expansion cylinder 1 and the compression cylinder 8. The reference numeral 23 designates a rotating axis seal for preventing the sealed gas in the crankcase 101 from leaking out from the gap between the crankcase 101 and the crankshaft 15. The numeral 19 designates a first elastic film such as a bellows provided below the expansion cylinder 1 inside the crankcase 101. One end of the elastic film 19 is fixed to the bottom of the expansion cylinder 1 and the other end thereof is fixed to the displacer rod 6 projecting into the crankcase, thereby constituting a first hermetically sealed space 19*a* surrounded by the first rod seal 7 and the first elastic film 19 which space is perfectly separated from the crankcase. The numeral 20 designates a second elastic film for partitioning the compression cylinder 8 from the crankcase. One end of the second elastic film 20 is fixed to the bottom of the expansion cylinder 8 and the other end thereof is fixed to the power piston rod 11, thereby constituting a second hermetically sealed space 20*a* surrounded by the lower surface of the power piston 10, the internal wall of the compression cylinder 8, and the second elastic film 20 which space is perfectly separated from the crankcase. The numeral 21 designates a second communicating pipe for communicating the first hermetically sealed space 19*a* and the buffer chamber 18 which pipe is connected to the connecting portion 22 of the buffer chamber 18. The second hermetically sealed space 20*a* is directly connected to the buffer chamber 18.

Figure 3:
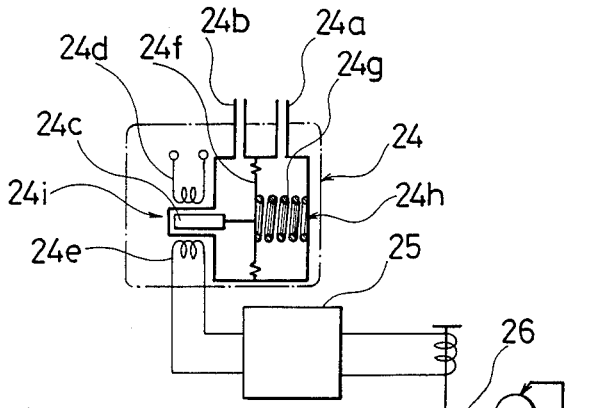
FIG. 3 is a schematic diagram showing a concrete example of the pressure adjusting means of the engine FIG. 2.

The reference numeral 24 designates a pressure difference meter for detecting the pressure difference between the pressure in the buffer chamber 18 and that in the crankcase. As shown in FIG. 3, the pressure difference meter 24 comprises a diaphragm device 24*h* constituted by a diaphragm 24*f* and a diaphragm spring 24*g*, and a transformer 24*i* constituted by a primary coil 24*d*, a secondary coil 24*e*, and a core 24*c*. The numeral 24*b* designates an inlet pipe for introducing the pressure in the crankcase, and the numeral 24*a* designates an inlet pipe for introducing the pressure in the buffer chamber 18.

The numeral 25 designates an operational control circuit intended to generate a signal in accordance with the pressure difference. The numeral 26 designates an electro-magnetic valve which is opened or closed by the signal, and this valve is controlled by the operational control circuit 25 so that the pressure difference from the pressure difference meter 24 may become 0. The numeral 27 designates a pressure control apparatus having a secondary controlled pressure which is equal to the mean pressure in the reactive space which includes the buffer chamber 18, space 19*a*, space 20*a* and pipe 21.

The numeral 29 designates a third communicating pipe for supplying gas to the crankcase.

This Stirling engine is operated as follows:

The working space is constituted by the expansion cylinder 1, the heater tube 2, the regenerator 3, the cooler tube 4, the compression cylinder 8, and the first communicating pipe 9. The reactive space which decides the mean pressure of the working space is constituted, as noted previously by the buffer chamber 18, the first hermetically sealed space 19*a*, the second hermetically sealed space 20*a*, and the second communicating pipe 21. The mean pressure of the working space, that of the reactive space, and the pressure in the crankcase can be held at an approximately equal pressure. That is, when the pressure in the crankcase is lowered, for example, by about $0.5 \sim 2$ kg/cm$^2$ by the leakage of the gas in the crankcase from the rotating axis seal 23 of the crankshaft, the pressure difference meter 24 converts the pressure difference between the pressure in the buffer chamber 18 and that in the crankcase into a displacement of the core 24*c* by the diaphragm device 24*h*, and further converts that displacement into the variation of the impedance of the transformer 24*i* to obtain an electric quantity in accordance with the pressure difference, and the operational control circuit 25 compares the electric quantity from the pressure difference meter 24 and the reference electric quantity at 0 pressure difference, and supply gas from the high pressure gas tank 28 to the crankcase through the pressure control apparatus 27 (pressure adjusting means) by opening the electro-magnetic valve 26 until the pressure difference becomes approximately equal to 0. Hereupon, the pressure control apparatus 27 operates to reduce the pressure in the high pressure gas tank 28 to become equal to that in the buffer chamber 18. Thus, the gas is automatically supplied to the inside of the crankcase from the high pressure gas tank 28, and the mean pressures in the three spaces are held approximately equal to each other.

Accordingly, the gas pressures applied to the elastic films 19, 20 can be regarded as 0 because the pressures in the first and the second sealed space 19*a*, 20*a* and the pressure in the crankcase are equal to each other. The elastic films 19 and 20 can be designed by only taking into consideration the exhaustion by the expansion and contraction thereof which corresponds to the both strokes of the displacer and the power piston.

Furthermore, hydrogen or helium having a low viscosity, a low molecular weight, and a high thermal conductivity is sealed in the working space and the reactive space which are pertinent to the engine efficiency, and it becomes capable of using a gas having a high molecular weight and a high viscosity such as air or nitrogen as a gas in a crankcase which does not directly have any influence upon the engine efficiency. So, the leakage of gas from the rotating axis seal between the crankcase 100 and the crankshaft is lowered to approximately 1/10 as compared with the case of using hydrogen or helium, thereby realizing the practical use of the engine.

In the illustrated embodiment shown in FIG. 2, a displacer and a power piston are provided separately, but the present invention can also be applied to a second type Stirling engine which has a displacer and a power piston in a cylinder.

Figure 4:
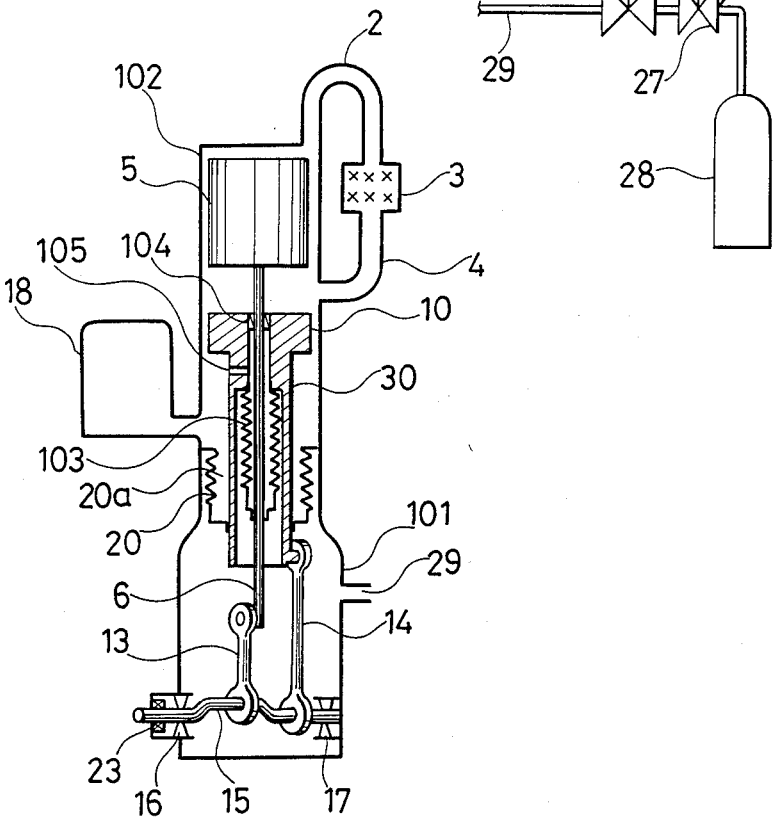
FIG. 4 is a schematic diagram showing a second or $\beta$ type Stirling engine as a second embodiment of the present invention.

This second type Stirling engine is employed in a second embodiment of the present invention and is shown in FIG. 4 wherein the same reference numerals designate the same elements as those shown in FIG. 2. The reference numeral 102 designates a cylinder which operates as both of the expansion cylinder and the compression cylinder in FIG. 2. In this engine construction the gas supply piston 5 and the power piston 10 are arranged on a same axis line. The numeral 103 designates a first elastic film provided between the power piston 10 and the gas supply piston rod 6. The mumeral 104 designates a first rod seal for sealing the sliding gap between the power piston 10 and the gas supply piston rod 6. The numeral 105 designates a communicating opening for communicating between the second hermetically sealed space 20*a* and the space produced between the first rod seal 104 and the first elastic film 103 at the side space of the power piston rod 6. This communicating opening 105 has the same function as that of the second communicating pipe 21 in FIG. 2.

In the second type Stirling engine under such a construction, the first and the second elastic film can be designed by only taking into consideration the exhaustion by the expansion and compression thereof which corresponds to the both strokes of the displacer and the power piston by the function of the apparatus constituted by the components 29, 24, 25, 26, 27, and 28 shown in FIG. 2. Of course, the same operation and effects are obtained as those of the first embodiment.

Furthermore, the present invention can be applied to a third type Stirling engine which has two cylinders, and has confronting pistons.

Figure 5:
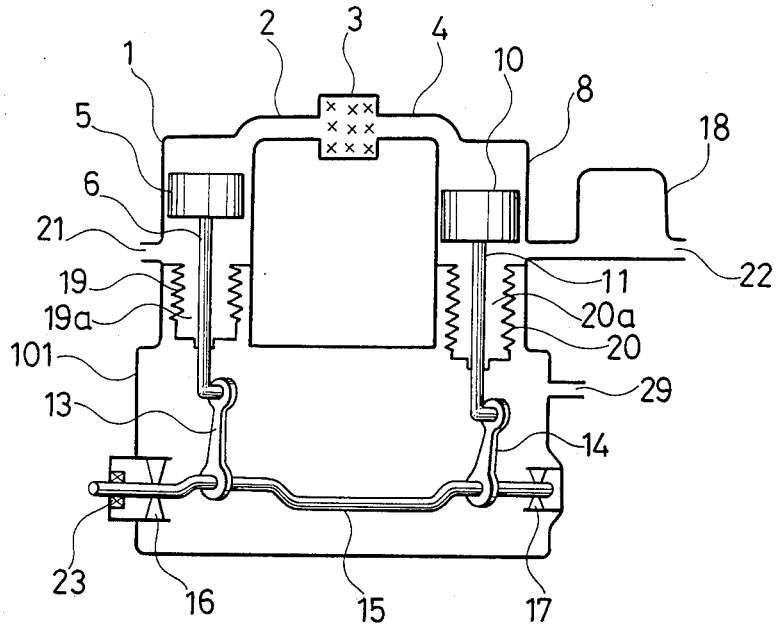
FIG. 5 is a schematic diagram showing a third or $\alpha$ type Stirling engine as a third embodiment of the present invention.

This third type Stirling engine is utilized in a third embodiment of the present invention and is shown in FIG. 5 wherein the same reference numerals designate same elements as those shown in FIG. 2. In this embodiment the displacer 5 is also called as an expansion piston. Similarly as the first and the second embodiments the first and the second elastic film can be designed by only taking into consideration the exhaustion by the expansion and compression thereof which corresponds to the both strokes of the displacer and the power piston by the function of the apparatus constituted by the components 29, 24, 25, 26, 27, and 28 shown in FIG. 2, and the same operation and effects are obtained as those of the first embodiment.

As described above, according to the present invention, an elastic film is used to seal between each cylinder and each rod related to the cylinder, and the working space, the reactive space, and the crankcase are sealed respectively so as to obtain a mean pressure equal to each other.

Furthermore, a gas having a large molecular weight and a high viscosity such as air or nitrogen is used in the crankcase which cannot be perfectly sealed, thereby lowering the leakage from the rotating axis seal to about 1/10 as compared with the case of using hydrogen or helium. This is quite advantageous in the practical use of the Stirling engine.

What is claimed is:

1. A Stirling engine wherein a pressure variation is provided by reciprocative movement of a displacer and is utilized by a power piston to obtain an output motive force, which comprises:

a pressurized crankcase, an expansion cylinder having a seal carrying wall, a displacer located in said expansion cylinder, a displacer rod connected to said displacer and projecting through said seal and into said crankcase, a first elastic film attached to said displacer rod and to said seal carrying wall so as to produce a first hermetically sealed space, a compression cylinder, a power pistion having a power pistion rod located in said compression cylinder, a second elastic film attached to said power piston rod and to said compression cylinder so as to produce a second hermetically sealed space below said power piston, said first and said second hermetically sealed spaces being included in a pressurized reactive space, a pressure adjusting means for equalizing the mean pressure within said reactive space and the mean pressure within said crankcase, a heater tube, a regenerator, and a cooler tube are connected to said expansion cylinder, and are included in a working space, as is the expansion cylinder and the compression cylinder, and a first gas having a low viscosity, a low molecular weight and a high thermal conductivity is sealed in said working space and said reactive space, and a second gas having a high viscosity and a high molecular weight is sealed in said crankcase.

2. A Stirling engine as set forth in claim 1, wherein said first gas is helium.

3. A Stirling engine as set forth in claim 1, wherein said pressure adjusting means comprises:

pressure difference meter for detecting the pressure difference between the means pressure in said reactive space and that in said crankcase;

an operational control circuit means for generating an electric signal in accordance with the pressure difference;

an electro-magnetic valve intended to be opened or closed by the electric signal; and a pressure controlling apparatus for supplying a second gas having a pressure equal to the mean pressure in the reactive space through the valve.

4. A Stirling engine as set forth in claim 1, wherein said first gas is hydrogen.

* * * * *